US007500586B2

(12) United States Patent
Oliveira-Martinez

(10) Patent No.: US 7,500,586 B2
(45) Date of Patent: Mar. 10, 2009

(54) HANGER FOR HEADBANDS AND ELASTIC PONYTAIL LOOPS

(75) Inventor: Julia Oliveira-Martinez, Pembroke Pines, FL (US)

(73) Assignee: Danver LLC, Pembroke Pines, FL (US)

( * ) Notice: Subject to any disclaimer, the term of this patent is extended or adjusted under 35 U.S.C. 154(b) by 0 days.

(21) Appl. No.: 11/224,653

(22) Filed: Dec. 1, 2005

(65) Prior Publication Data

US 2007/0125811 A1 Jun. 7, 2007

(51) Int. Cl.
*A41D 27/22* (2006.01)

(52) U.S. Cl. ..... 223/85; 211/119

(58) Field of Classification Search ..... 223/DIG. 1, 223/DIG. 2, DIG. 4, 85, 88, 92, 95, 97; D6/315, D6/317, 328; 211/85.2, 85.3, 113, 119
See application file for complete search history.

(56) References Cited

U.S. PATENT DOCUMENTS

| | | | | | |
|---|---|---|---|---|---|
| 254,451 | A | * | 3/1882 | Bisbee | 223/88 |
| 1,286,595 | A | * | 12/1918 | Jacobs | 223/85 |
| 1,563,735 | A | * | 12/1925 | Fetters | 223/88 |
| 2,058,217 | A | | 10/1936 | Dixon | |
| 2,076,824 | A | * | 4/1937 | Ott | 223/88 |
| 2,127,870 | A | | 8/1938 | Kennedy | |
| 2,151,621 | A | * | 3/1939 | Silverman | 223/88 |
| 2,198,768 | A | * | 4/1940 | Goldman | 223/88 |
| 2,232,028 | A | * | 2/1941 | Isaak | 223/88 |
| 2,341,643 | A | * | 4/1944 | Mincenberg | 223/66 |
| 2,468,526 | A | * | 4/1949 | Tusay | 223/88 |
| 2,593,356 | A | | 4/1952 | Smith | |
| 2,609,104 | A | * | 9/1952 | Leach | 211/113 |
| D175,456 | S | | 8/1955 | Behlefeldt | |
| 2,786,615 | A | * | 3/1957 | Saibene | 223/25 |
| D190,608 | S | | 6/1961 | Forrester | |
| 3,029,990 | A | * | 4/1962 | Roberts et al. | 223/88 |
| 3,138,259 | A | | 6/1964 | Sitt | |
| D198,960 | S | * | 8/1964 | Bertram | D6/315 |
| 3,194,457 | A | | 7/1965 | Freilich | |
| 3,342,345 | A | * | 9/1967 | Van Dusen | 211/119 |
| 3,448,902 | A | * | 6/1969 | Stebbins | 223/85 |
| D229,001 | S | * | 11/1973 | Wahl | D6/317 |
| D229,003 | S | * | 11/1973 | Wahl | D6/317 |
| 4,429,797 | A | * | 2/1984 | Collins | 211/119 |
| 4,669,615 | A | * | 6/1987 | Zigman | 211/34 |
| 4,778,088 | A | | 10/1988 | Miller | |

(Continued)

OTHER PUBLICATIONS

Carol Duvall, Shoebox: HairBand Holder, HGTV, http://www.hgtv.com/hgtv/crafting/article/0,,HGTV_3352_1399650,00.html.*

(Continued)

*Primary Examiner*—Gary L Welch
*Assistant Examiner*—Nathan E Durham
(74) *Attorney, Agent, or Firm*—Jose Gutman

(57) ABSTRACT

A hanger is adapted for retaining and hanging objects. The hanger includes a hook having first and second ends, a bead being attached to the second end. The hook defines an upper portion of the hanger. A lower hanger portion includes a spiral-shaped body having first and second ends, the second end being free to accept objects for hanging on the lower hanger portion. The first end of the lower hanger portion is coiled around the second end of the hook upper portion of the hanger.

10 Claims, 2 Drawing Sheets

U.S. PATENT DOCUMENTS

| | | | | | |
|---|---|---|---|---|---|
| 4,966,287 | A | | 10/1990 | Snyder | |
| D334,668 | S | * | 4/1993 | Miyahara | D6/317 |
| 5,303,855 | A | | 4/1994 | Veale | |
| D353,056 | S | * | 12/1994 | De Santis | D6/315 |
| 5,799,842 | A | * | 9/1998 | Rumsey | 223/DIG. 2 |
| D409,004 | S | | 5/1999 | Bartholow | |
| 6,334,559 | B1 | * | 1/2002 | Armaly | 223/85 |
| D526,131 | S | * | 8/2006 | McGowan | D6/317 |

OTHER PUBLICATIONS

BeltScarfRing, product available for sale, by Neu Home, Apr. 2007, Linens-N-Things.

Belt and Accessory Hanger, product available for sale, May 2006, Amazon.com.

* cited by examiner

HANGER FOR HEADBANDS AND ELASTIC PONYTAIL LOOPS

TECHNICAL FIELD

The present invention is related to a device for hanging objects; more particularly the present invention is a hanger configured to hold and display looped objects such as hair-bands.

BACKGROUND OF THE INVENTION

Hangers for objects such as neckties or belts are well known in the art, in particular, many of these hangers are configured to hold at least one necktie or belt suspended form a support such as a rod or a hoop. A problem with this type of arrangement is that objects that form closed loops themselves, such as hair-bands, cannot be hung on closed hoops, and cannot be securely hung on linear rods without the possibility that they will slip off. Shortcomings of current hanger designs are that the portions of the devices intended to hold the objects are closed, or are linear. Thus there is a need for an improved hanger.

These and other objects, advantages, and features of the invention will become apparent to those persons skilled in the art upon reading the details of the methods and systems of the present invention, which are more fully described below.

SUMMARY OF THE INVENTION

A hanger for headbands and elastic ponytail loops according to the invention is provided. The device allows any small, flexible looped object such as a headband or an elastic ponytail hoop to be placed on it and allows for the looped object to be removed singly, without having to remove the other looped objects. The device may be hung from any structure that will accept the hooked end of the device.

This device may be used to hang any small, looped object.

The head-band hanger is made of steel wire of 3 mm diameter. It has two main pieces, a hook and a circle. The hook ends in a small decorative ball. The ball is placed so that the metal circle (which is coiled around the hook and hangs from it) does not fall off. The metal circle is the other piece, it forms a circle of more than 360 degrees, and does not close, so it has the appearance of a one and a quarter turn coil. One end is coiled around the bottom portion if the hook, so that it can swivel. The other end has a small decorative ball to match the ball on the hook, and to prevent rough edged on the metal. The circle has a diameter of 4 inches.

In accordance with the present invention there is provided a hanger assembly configured to retain/hold and/or display items such as hair-bands, neckties, necklaces, or similar items. The hanger assembly includes a hook attached to spiral, wherein the hook may be used to hang the hanger from a fixed support. A lower spiral assembly is attached to the upper hook by winding one end of the spiral around the base of the hook. A bead is attached to the lower end of the hook to keep the wound portion of the spiral from sliding off.

BRIEF DESCRIPTION OF THE FIGURES

To facilitate understanding, the same reference numerals have been used (where practical) to designate similar elements that are common to the Figures. Some such numbering has, however, been omitted for the sake of drawing clarity.

FIG. 1 is a right lateral (sideways) view of a head-band hanger.

FIG. 2 is a left lateral sideways view of the head-band hanger.

DETAILED DESCRIPTION OF THE PREFERRED EMBODIMENTS

Figure 1:
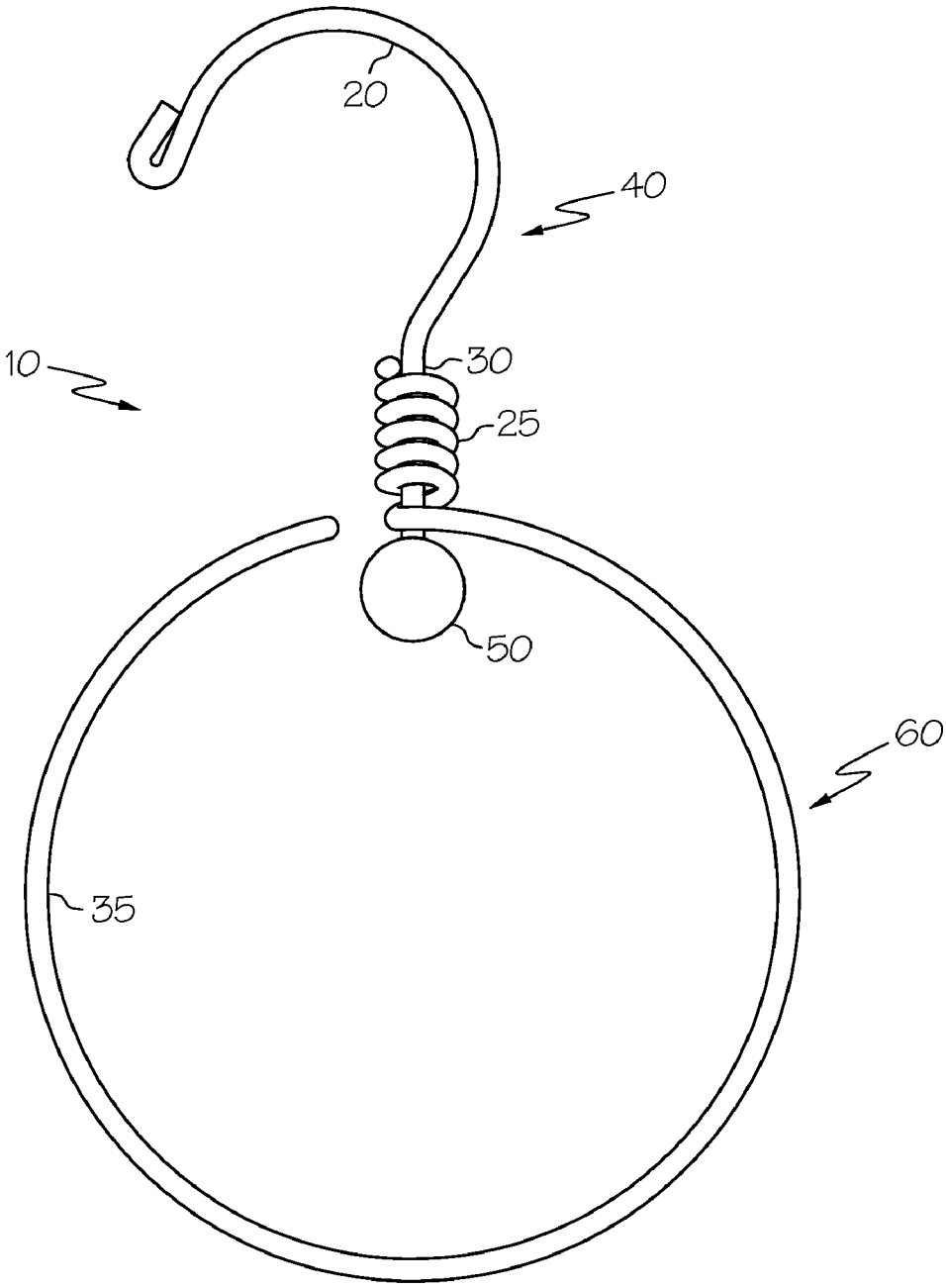
FIG. 1 is an exemplary embodiment of the hanger in accordance with the present invention.

Before the present invention is described in such detail, it is to be understood that this invention is not limited to particular variations set forth herein as various changes or modifications may be made to the invention described and equivalents may be substituted without departing from the true spirit and scope of the invention. In addition, many modifications may be made to adapt a particular situation, material, and composition of matter, process, process act(s) or step(s) to the objective(s), spirit or scope of the present invention. All such modifications are intended to be within the scope of the claims made herein.

Methods recited herein may be carried out in any order of the recited events that is logically possible, as well as the recited order of events. Furthermore, where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

All existing subject matter mentioned herein (e.g., publications, patents, patent applications and hardware) is incorporated by reference herein in its entirety except insofar as the subject matter may conflict with that of the present invention (in which case what is present herein shall prevail). The referenced items are provided solely for their disclosure prior to the filing date of the present application. Nothing herein is to be construed as an admission that the present invention is not entitled to antedate such material by virtue of prior invention.

Reference to a singular item, includes the possibility that there are plural of the same items present. More specifically, as used herein and in the appended claims, the singular forms "a," "and," "said" and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation. Last, it is to be appreciated that unless defined otherwise, all technical and scientific terms used herein have the same meaning as commonly understood by one of ordinary skill in the art to which this invention belongs.

In accordance with the present invention there is provided a hanger assembly configured to retain/hold and/or display items such as hair-bands, bracelets, necklaces, or similar items. The hanger including a hook having first and second ends, and a bead attached to the second end, defining an upper portion of the hanger. A lower hanger portion, the lower hanger portion including a spiral having first and second ends, the first end of the spiral being coiled around the straight portion of the hook, and second end which is the end of the spiral.

Referring now to FIG. 1, there is shown an exemplary embodiment of a hanger assembly in accordance with the present invention. As show in FIG. 1, the hanger assembly 10 includes hook assembly 40 and a lower spiral assembly 60, wherein the upper and lower assemblies combined form the entire hanger assembly 10.

The upper assembly 40 includes a hooked portion 20 and a straight portion 30. A bead 50 is attached to the straight portion 30. The bead 50 and the straight portion 30 may be attached to one another using mechanical means such as soldering, welding, threading or similar methods or through the use of glues, heat-sealing, or other similar means.

The lower assembly includes a coiled portion 25 and a spiral portion 35. The coiled portion 25 as shown is coiled around the straight portion 30, in such a way that the lower spiral assembly 60 can turn freely around the axis formed by the straight portion 30.

The bead 50 is attached to the straight portion 30 at the terminus of the straight portion 30. The bead 50 is attached to the straight portion 30 below the coiled portion 25. The bead 50 is configured to prevent the lower spiral assembly 60 from slipping off the straight portion 30.

Hooked portion 20 and a straight portion 30 may be constructed of materials such as ferrous or non-ferrous metals, ceramics, plastics and other similar methods. Additionally, in a preferred embodiment the hook is generally circular in shape, though it is contemplated that other shapes may be substituted without departing from the scope of the invention. Upper assembly 40 is configured to receive a fixed support, or additional hanging means such as chain, rope, metal loops, and such.

Bead 50 may be constructed of materials such as steel, stainless steel, titanium, ceramic, plastic, wood, or other similar materials.

Figure 2:
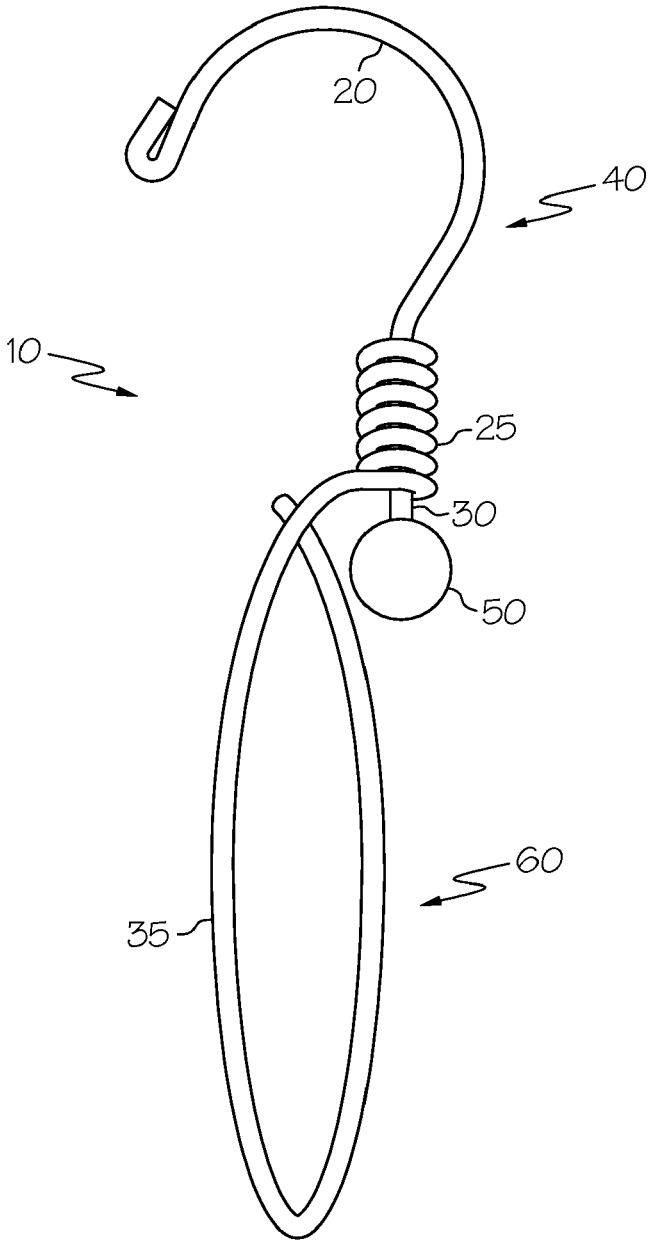
FIG. 2 is side view of an exemplary embodiment of the hanger in accordance with the present invention.

Referring now to FIG. 2, there is shown a side view of the hanger assembly 10 in accordance with the present invention. As shown in FIG. 2, the lower assembly 60 of the hanger is configured to retain objects such as a hair-band, shown in dotted outline.

Although the hanger of the present invention has been shown and described as being configured to retain items such as hair-bands, it is contemplated that the hanger could be utilized to retain other items. Such items could be but not limited to: neckties, necklaces, and belts. It is contemplated that modifications may be made to the lower spiral portion of the hanger to retain items of this type without departing from the scope of the present invention.

As various changes could be made in the above constructions without departing from the scope of the invention, it is intended to that all matter contained in the above description or shown in the accompanying drawings shall be interpreted as illustrative and not in a limiting sense.

The instant invention is shown and described herein in what is considered to be the most practical, and preferred embodiments. It is recognized, however, that departures may be made there from, which are within the scope of the invention, and that obvious modifications will occur to one skilled in the art upon reading this disclosure.

What is claimed is:

1. A hanger, adapted for retaining and hanging objects, comprises:

a hook having first and second ends, the first end consisting of a hooked portion for hooking onto a separate supporting object and the second end comprising a straight portion formed to vertically point downward due to gravity when the hook is hooked on the supporting object and the hanger is only supported thereby; and a lower hanger portion having a coil and a spiral-shaped body that has first and second ends, the body being spiral-shaped in a lateral direction along a length of the body from the first end to the second end, a spiral of the spiral-shaped body occupying a volume having three dimensions, each dimension being substantially larger than a non-lateral dimension of a cross-section of the body, the second end being a permanently open terminus of the spiral-shaped body for hanging looped objects on the spiral-shaped body and the first end being connected to the coil in the lower hanger portion, the coil being a separate portion of the lower hanger portion from the spiral-shaped body, and the coil being coiled around the straight portion of the second end of the hook to permit horizontal rotation of the spiral-shaped body with respect to the vertical downwardly pointing straight portion of the hook.

2. The hanger according to claim 1, wherein said hook is constructed of a material chosen from the group consisting of: steel, stainless steel, titanium, ceramic, plastic, or a combination thereof.

3. The hanger according to claim 1, wherein said spiral-shaped body is constructed of a material chosen from the group consisting of: steel, stainless steel, titanium, ceramic, plastic, or a combination thereof.

4. The hanger according to claim 1, wherein said straight portion has a bead attached to the end thereof, the coil in the lower hanger portion being coiled with multiple windings around the straight portion of the second end of the hook portion, and wherein said bead is constructed of a material chosen from the group consisting of: steel, stainless steel, titanium, ceramic, plastic, wood, or a combination thereof.

5. The hanger according to claim 4, wherein said bead is configured, and sized greater than the coiled multiple windings of the coil in the lower hanger portion, to support the lower hanger portion by the bead of the straight portion of the hook by preventing the coil of the lower hanger portion from sliding off the straight portion.

6. The hanger according to claim 1, wherein said lower hanger portion being configured to have the terminus of the permanently open end of the spiral-shaped body located at a fixed predefined height above approximately a lowest-point level of the spiral-shaped body when the hanger is hanging on said supporting object, and thereby the lower hanger portion being configured to retain on the spiral-shaped body of the lower hanger portion one or more hair bands, ponytail loops, or any combination thereof.

7. A hanger, adapted for retaining and hanging banded or looped objects, comprising:

an upper hook portion having first and second ends, the first end consisting of a hooked body for hooking onto a separate supporting object and the second end consisting of a straight body with a bead attached thereto, the straight body being formed to vertically point downward due to gravity when the upper hook portion is hooked on the supporting object and the hanger is only supported thereby; and a lower hanger portion having a coil and a spiral-shaped body that has first and second ends, the body being spiral-shaped in a lateral direction along a length of the body from the first end to the second end, a spiral of the spiral-shaped body also extending along a non-lateral dimension of a cross-section of the body thereby increasing in the non-lateral dimension a volume of space occupied by the spiral-shaped body the second end being a permanently open terminus of the spiral-shaped body for hanging looped objects on the spiral-shaped body, and the first end being connected to the coil in the lower hanger portion, the coil being a separate portion of the lower hanger portion from the spiral-shaped body, and the coil being coiled around the straight body of the second end of the upper hook portion and above the bead to permit horizontal rotation of the spiral-shaped body with respect to the vertical downwardly pointing straight portion of the hook, wherein said lower hanger portion being configured to have the terminus of the permanently open end of the spiral-shaped body located at a fixed predefined height above approximately a lowest-point level of the spiral-shaped body when the hanger is hanging on said supporting object, and thereby the lower hanger portion being configured to retain on the spiral-shaped body of the lower hanger portion one or more hair bands, ponytail loops, or any combination thereof.

8. A hanger, adapted for retaining and hanging banded or looped objects, comprising:

an upper hook portion having first and second ends, the first end consisting of a hooked body for hooking onto a separate supporting object and the second end consisting of a straight body with a bead attached thereto, the straight body being formed to vertically point downward due to gravity when the upper hook portion is hooked on the supporting object and the hanger is only supported thereby; and a lower hanger portion having a coil and a spiral-shaped body that has first and second ends, the body being spiral-shaped in a lateral direction along a length of the body from the first end to the second end, a spiral of the spiral-shaped body occupying a volume having three dimensions, each dimension being substantially larger than a non-lateral dimension of a cross-section of the body, the second end being a permanently open terminus of the spiral-shaped body for hanging looped objects on the spiral-shaped body, and the first end being connected to the coil in the lower hanger portion, the coil being a separate portion of the lower hanger portion from the spiral-shaped body, and the coil being coiled around the straight body of the second end of the upper hook portion and above the bead to permit horizontal rotation of the spiral-shaped body with respect to the vertical downwardly pointing straight portion of the hook, wherein said lower hanger portion being configured to have the terminus of the permanently open end of the spiral-shaped body located at a fixed predefined height above approximately a lowest-point level of the spiral-shaped body when the hanger is hanging on said supporting object, and thereby the lower hanger portion being configured to retain on about the lowest-point of the spiral-shaped body of the lower hanger portion one or more hair bands, ponytail loops, or any combination thereof.

9. The hanger according to claim 8, wherein said hook portion and hanger portion are constructed of the same material.

10. The hanger according to claim 8, wherein said same material being chosen from the group consisting of: steel, stainless steel, titanium, ceramic, plastic, or wood.

* * * * *